United States Patent [19]

Mohlman

[11] 3,967,677

[45] July 6, 1976

[54] HEAT EXCHANGER BAFFLES

[75] Inventor: Paul Heinze Mohlman, Lawndale, Calif.

[73] Assignee: Mobil Oil Corporation, New York, N.Y.

[22] Filed: May 28, 1975

[21] Appl. No.: 581,457

[52] U.S. Cl. ..... 165/162; 122/510

[51] Int. Cl.[2] ..... F28F 9/00

[58] Field of Search ..... 138/112; 165/159–162; 122/510

[56] References Cited

UNITED STATES PATENTS

| | | | |
|---|---|---|---|
| 2,018,037 | 10/1935 | Sieder | 165/162 |
| 2,198,529 | 4/1940 | Fields | 165/162 X |
| 3,399,719 | 9/1968 | Forrest et al. | 165/162 X |
| 3,420,297 | 1/1969 | Romana | 165/162 |
| 3,907,031 | 9/1975 | Tegetoff | 165/162 |

*Primary Examiner*—Charles J. Myhre
*Assistant Examiner*—Theophil W. Streule, Jr.
*Attorney, Agent, or Firm*—C. A. Huggett

[57] ABSTRACT

A square pitch shell and tube heat exchanger is provided with support rods in a set pattern between and perpendicular to the exchanger tubes to provide improved shell side fluid movement across the tubes and regular support for the tubes.

3 Claims, 4 Drawing Figures

HEAT EXCHANGER BAFFLES

BACKGROUND OF THE INVENTION

Shell and tube heat exchangers are widely used in industry for heating, cooling, condensing and evaporating fluids by flowing one fluid through the tubes (tube side) and a second fluid through the shell outside the tubes (shell side). The heat exchanger must be carefully engineered for the service intended to provide maximum efficiency in transfer of heat through the tube walls and between the shell side fluid and the tube side fluid. The present invention is concerned with mechanical support for the tubes in a manner to suppress destructive vibration thereof and with improved baffling of shell side for improved turbulence of that fluid to maximize heat transfer while reducing pressure drop across the shell to minimize pumping costs.

It is usual to provide baffles on the shell side. Conventionally, these are baffle plates extending from alternate sides of the shell interior across the tubes. Such baffles are provided with suitable openings for the tubes. Plate baffles support the tubes and partially determine the heat duty of the exchanger by the spacing between the baffles. To increase heat duty, the spacing between baffles must be reduced thereby increasing the number of passes across the tubes by the shell side fluid. Usually, a higher shell pressure drop tends to offset the so obtained gain in heat duty.

It will be apparent that, back of each plate baffle in the direction of shell side flow, there will exist an area of stagnation such that the total area of heat transfer wall of the tubes is reduced by the extent of such area in the "dead spaces" back of baffles.

In addition it is found that the flow of shell side fluid across the tubes tends to cause the same to vibrate. Each tube will have characteristic frequencies of vibration depending upon unsupported length and the like. Excitation of low frequency natural periods of vibration can cause excessive wear of tube walls at the points of passage through plate baffles. Premature failure of tubes from this cause has been frequently observed. See "Acoustic Vibrations in Tubular Exchangers", E. A. Barrington, Chem. Eng. Progr., Vol. 69, pages 62–68 (July, 1973).

An advance in tube support is described in U.S. Pat. No. 3,708,142, Small. The system set out in the Small patent is also discussed in "Tube Vibration In A Thermosiphon Reboiler", J. F. Eilers & W. M. Small, Chem. Eng. Progr., Vol. 69, pages 57–61, (July, 1973). The arrangement so described provides lengths of bar stock extending across the tube bundle in the spaces between columns of tubes and the spaces between rows of tubes. The rods are passed through every such space and welded at their ends to a metal strip about the bundle which assumes an elliptical form because the rods are spaced longitudinally of the tube bundle.

SUMMARY OF THE INVENTION

The present invention provides a method and apparatus for support and restraint of heat exchanger tubes along their length in a manner to prevent misalignment of tubes either by sagging or other distortion, with concurrent improvement in exchanger efficiency and pressure drop and improved suppression of destructive vibration effects.

These results are achieved in a square pitch shell and tube heat exchanger by a novel arrangement of support rods disposed in a cylindrical heat exchanger shell at right angles to the longitudinal axis of the shell and hence at right angles to length of the tubes. The intersection of the plane in which the rods lie with the cylindrical shell is, of course, an ellipse of which the minor axis equals the diameter of the shell and the major axis varies with the angular displacement of the grid from normal to the axis of the shell. That angular displacement is determined by size and spacing criteria discussed below. The ends of the rods are welded to a strap about the tube bundle. The strap is in the form of the ellipse previously described.

To this extent, the invention utilizes an arrangement like that of the prior art, e.g., U.S. Pat. No. 3,708,142. A principal departure is that all the rods of all the sets are parallel to the minor axis of the ellipse and that the projections of major axes of successive ellipses to a plane normal to the axis of the shell form angles of 90° with each other. Preferably the rods are positioned such that two sets of rods at right angles to each other are at the same position along the tubes, providing an intersecting pattern, all as shown in more detail on the annexed drawings.

DESCRIPTION OF PREFERRED EMBODIMENTS

Figure 1:
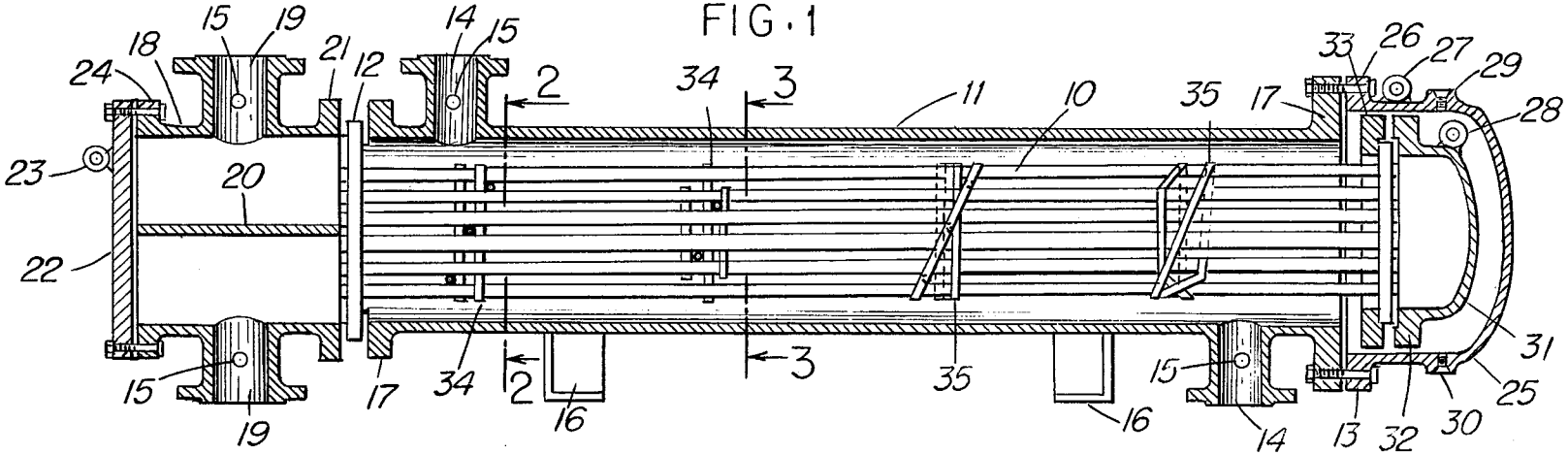
FIG. 1 is a view in elevation of a square pitch, shell and tube heat exchanger according to the invention, the shell being shown in section.
Figure 3:
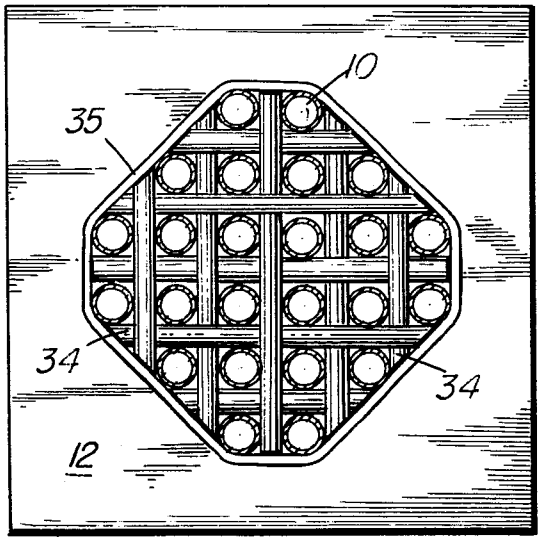
FIG. 3 is a section of the tube bundle on line 3—3 of FIG. 1.

As shown in FIG. 1, the invention may be applied to a shell and tube heat exchanger having a plurality of tubes 10 arranged in square pitch, that is, in a pattern such that the centers of four tubes adjacent each other form the corners of a square. The tubes are disposed in a cylindrical shell 11 with their ends rolled into a stationary tube sheet 12 and a floating tube sheet 13, respectively.

The shell is provided with nozzles 14 spaced as shown to induce flow of shell side fluid across and along the length of the tubes. Each nozzle 14 is tapped, as at 15 for instrument connection. The shell 11 is further provided with support saddles 16 for mounting and with flanges 17 at the ends of the shell for assembly with the heads.

A stationary head 18 having nozzles 19 and a pass partition 20 is provided with flange 21 for assembly with shell 11 by bolts (not shown) passing through flange 21 and opposing flange 17 of shell 11. It will be seen that flanges 17 and 21 will clamp on tube sheet 12 in closed position by a joint which may be provided with gaskets according to normal practice in the art. At the side of stationary head 18 remote from tube sheet 12, a plate 22 fitted with lifting lug 23 is secured in suitable manner to a flange 24 of stationary head 18.

At the end of shell 11 remote from stationary head 18 is a shell cover 25 formed with a flange 26 by which it may be secured to the flange 17 at the adjacent end of shell 11. The shell cover 25 is fitted with a lifting lug 27 and is tapped for a vent connection at 29 and a drain connection at 30.

Within the shell cover 25, is a floating head cover 31 provided with lifting lug 28 and flange 32 by which it may be bolted to floating head backing ring 33 against the tube sheet 13.

The above described structure is a conventional shell and tube heat exchanger except for omission of plate baffles, together with the tie rods and separators required to maintain such plate baffles in position. It will be seen that tube side fluid enters by one of the nozzles 19 and passes through that half of the tubes open to the feed nozzle. Those tubes discharge to the chamber within floating head cover 31, from which tube side fluid passes through the other half of the tubes to the discharge nozzle. Shell side fluid enters by one of the nozzles 14, flows along and across the tubes 10 to discharge at the other nozzle 14, whereby heat is transferred from one fluid to the other through the walls of tubes 10.

According to the present invention, the tubes are supported in design position, tube vibration is suppressed (particularly at the more destructive low frequencies) and baffling of the shell side fluid is accomplished at low pressure drop and without inducing dead spaces by a plurality of rods 34 arranged in an unique pattern presently to be described.

Figure 4:
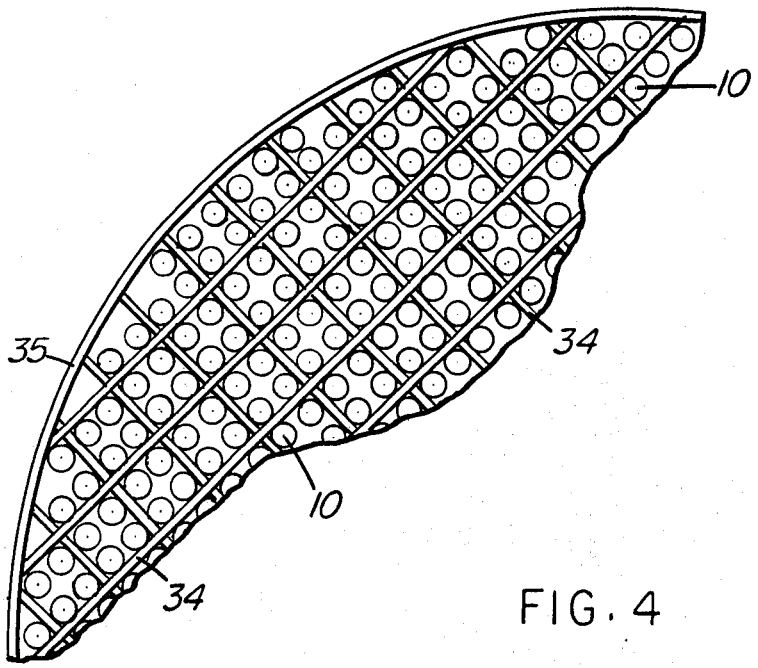
FIG. 4 is a fragmentary view in section illustrating application of the invention to a typical commercial pattern to an exchanger having 930 tubes.

As will be immediately apparent to those skilled in the art, the twenty-four tubes 10 shown in the annexed drawing is an abnormally small number of tubes 10. A commercial heat exchanger will normally have hundreds of tubes 10 arranged in bundles of generally cylindrical form. The small number of tubes in the annexed drawing facilitates illustration of the invention but results in some distortion of the normal generally circular cross-section of the tube bundle. Bearing in mind that tendency of the present drawings to distort a feature of the invention, a typical heat exchanger according to the invention may be equipped with 930 tubes of 3/4 inch outside diameter arranged in square pitch on 1-1/4 inch centers, as illustrated by a portion of one quadrant such exchanger set out in FIG. 4.

Figure 2:
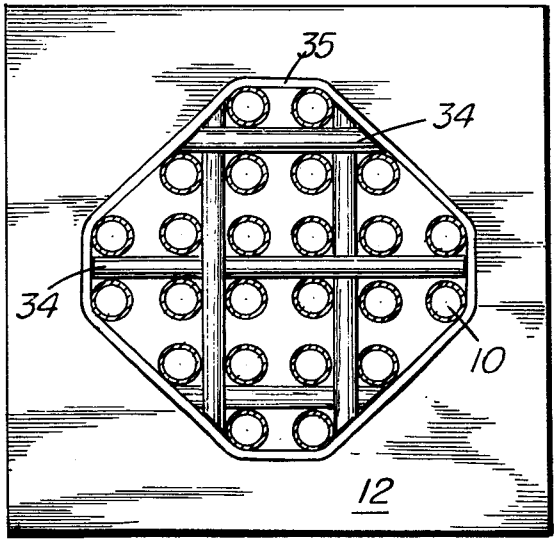
FIG. 2 is a section of the tube bundle on line 2—2 of FIG. 1.

A plurality of rods 34 cut from bar stock of 1/2 inch diameter are inserted in the spaces between tubes 10 parallel to sides of the squares defined by centers of the tubes 10. At each baffled region where rods 34 are inserted, two sets of such rods are set in at right angles to the tubes 10 and the rods of each set are at right angles to rods of the other set. Each set of rods is constituted by a rod at alternate spaces between tubes 10 whereby the remaining spaces between tubes 10 are left free of support rods at that particular baffled region, thus providing adequate baffling effect on the shell side fluid without serious added pressure drop. See FIG. 2.

As will be seen in FIG. 1, consecutive rods 34 of a set are displaced along the length of the tube bundle by a distance equal to the diameter of a rod 34 whereby the rods of a set define a plane, the intersection of which with the cylindrical envelope of the tube will be an ellipse. The resultant structure of a set of rods 34 is aptly termed an "oval baffle". As illustrated in FIG. 1, a baffled region of two intersecting oval baffles is followed by another baffled region of two intersecting oval baffles in which the rods 34 pass through the spaces between tubes 10 left free of rods 34 at the next adjacent baffled region. By this arrangement, positive support at each of the four quadrants of a tube 10 is provided by two adjacent baffled regions without sacrificing the advantages described above.

In practice, it is preferable to confine the tube bundle at each baffled region and secure the rods 34 in position by a strap 35 which is fitted closely to the tube bundle and having the ends of the rods 34 of a set welded thereto. The first two baffled regions on the left of FIG. 1 are shown without strap 35 for clarity of positioning of rods 34. It will be understood that rods 34 at the baffled regions indicated by strap 35 in FIG. 1 are arranged in like fashion to those at which strap 35 is omitted.

The unequal spacing of support points provided by the present invention results in unequal lengths of unsupported portions of adjacent tubes 10. This affords an additional advantage in suppression of vibration since adjacent tubes will not be tuned to like frequency of characteristic vibration and will therefore not tend to induce and reinforce vibration among them.

I claim:

1. In a shell and tube square pitch heat exchanger having a longitudinal shell, tube sheets at opposite ends of said shell, a plurality of parallel tubes in a bundle of generally cylindrical form extending between said tube sheets and arranged in a pattern such that the center lines of any four adjacent tubes are at the corners of a square, means to introduce fluid to said tubes and withdraw fluid from said tubes at the faces of said tube sheets, means to introduce fluid to the interior of said shell external of said tubes and to withdraw fluid therefrom;

the improved structure for baffling flow of shell side fluid and for supporting and stabilizing said tubes which comprises a first set of parallel rods extending between said tubes across said shell positioned in alternate spaces between tubes, a second set of parallel rods extending parallel to rods of said first set between said tubes across said shell in the spaces not so occupied by rods of said first set, third and fourth such sets arranged in like manner to said first and second sets, respectively, but at right angles to said first and second sets, successive rods of each set being spaced along the length of the exchanger to define a plane at an acute angle to the axis of said exchanger, whereby the ends of the rods in any said set define an ellipse, the rods being disposed parallel to the minor axis of said ellipse.

2. An improved heat exchanger according to claim 1 wherein the ends of the rods in each set are secured to an elliptical strap about the perimeter of said tubes.

3. An improved heat exchanger according to claim 1 wherein each said set is adjacent a second said set of which the rods are at right angles to the rods of the first mentioned said set and so arranged that the ellipses defined by ends of the rods in said adjacent sets intersect.

* * * * *